US007669789B2

(12) United States Patent
Hung et al.

(10) Patent No.: US 7,669,789 B2
(45) **Date of Patent: *Mar. 2, 2010**

(54) LOW PRESSURE FUEL INJECTOR NOZZLE

(75) Inventors: David Ling-Shun Hung, Novi, MI (US); Vivek A. Jairazbhoy, Farmington Hills, MI (US); David L. Porter, Westland, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 194 days.

This patent is subject to a terminal disclaimer.

(21) Appl. No.: 11/846,585

(22) Filed: Aug. 29, 2007

(65) Prior Publication Data

US 2009/0057445 A1 Mar. 5, 2009

(51) Int. Cl.

| | |
|---|---|
| ***F02M 61/04*** | (2006.01) |
| ***F02M 61/00*** | (2006.01) |
| ***F02M 63/00*** | (2006.01) |
| ***B05B 1/14*** | (2006.01) |

(52) U.S. Cl. ..... 239/533.12; 239/533.2; 239/558; 239/596

(58) Field of Classification Search . 239/533.2–533.14, 239/548, 558–561, 567, 585.1–585.5, 596, 239/601

See application file for complete search history.

(56) References Cited

U.S. PATENT DOCUMENTS

| | | | |
|---|---|---|---|
| 4,662,567 | A | 5/1987 | Knapp |
| 4,705,210 | A | 11/1987 | Graser et al. |
| 4,733,822 | A | 3/1988 | Romann |
| 4,830,286 | A | 5/1989 | Asslaender et al. |
| 5,131,599 | A | 7/1992 | Maier |
| 5,222,673 | A | 6/1993 | Reiter |
| 5,449,114 | A | 9/1995 | Wells et al. |
| 6,070,812 | A | 6/2000 | Tani et al. |
| 6,089,476 | A | 7/2000 | Sugimoto et al. |
| 6,189,816 | B1 | 2/2001 | Stier |
| 6,394,367 | B2 | 5/2002 | Munezane et al. |
| 6,405,946 | B1 | 6/2002 | Harata et al. |
| 6,439,484 | B2 | 8/2002 | Harata et al. |
| 6,581,574 | B1 | 6/2003 | Moran et al. |
| 6,616,072 | B2 | 9/2003 | Harata et al. |
| 6,712,037 | B2 | 3/2004 | Xu |
| 6,757,149 | B2 | 6/2004 | Moran |
| 6,766,788 | B2 | 7/2004 | Xu |
| 6,769,625 | B2 | 8/2004 | Peterson, Jr. |
| 6,779,743 | B2 | 8/2004 | Kitamura |
| 6,783,085 | B2 | 8/2004 | Xu |
| 6,789,754 | B2 | 9/2004 | Peterson, Jr. |
| 6,817,545 | B2 | 11/2004 | Xu |
| 6,820,826 | B2 | 11/2004 | Peterson, Jr. |
| 6,845,930 | B2 | 1/2005 | Peterson, Jr. |
| 6,848,635 | B2 | 2/2005 | Xu |
| 6,921,021 | B2 | 7/2005 | Nally et al. |
| 6,921,022 | B2 | 7/2005 | Nally et al. |
| 6,929,197 | B2 | 8/2005 | Peterson, Jr. |
| 6,938,839 | B2 | 9/2005 | Xu et al. |

(Continued)

*Primary Examiner*—Darren W Gorman
(74) *Attorney, Agent, or Firm*—Dickinson Wright PLLC

(57) ABSTRACT

A nozzle for a low pressure fuel injection that improves the control and size of the spray angle, as well as enhances the atomization of the fuel delivered to the cylinder for an engine, at relatively low pressures. The nozzle includes a metering plate having inner and outer exit cavities in rings spaced circumferentially about a center exit cavity.

20 Claims, 3 Drawing Sheets

U.S. PATENT DOCUMENTS 6,966,499 B2 11/2005 Nally et al.
6,966,505 B2 11/2005 Peterson, Jr.
6,974,095 B2 12/2005 Harata et al.
6,991,188 B2 1/2006 Kobayashi et al.
7,014,129 B2 3/2006 Dantes et al.
7,051,957 B1 5/2006 Goenka et al.
7,059,459 B2 6/2006 Miyoshi
7,059,547 B2 6/2006 Kobayashi et al.
7,059,549 B2 6/2006 Xu
7,077,340 B2 7/2006 Boecking
7,100,848 B2 9/2006 Kobayashi et al.
7,104,475 B2 9/2006 Goenka et al.
7,124,963 B2 10/2006 Goenka et al.
7,137,576 B2 11/2006 Xu
7,137,577 B2 11/2006 Goenka et al.
2002/0020766 A1 2/2002 Kobayashi et al.
2002/0125345 A1 9/2002 Harata et al.
2002/0179742 A1* 12/2002 Yildirim et al. ..... 239/533.3
2003/0015595 A1 1/2003 Peterson, Jr.
2003/0057300 A1 3/2003 Peterson, Jr.
2003/0127540 A1 7/2003 Xu
2003/0127543 A1* 7/2003 Rieger et al. ..... 239/584
2003/0141385 A1 7/2003 Xu
2003/0141387 A1 7/2003 Xu
2004/0000602 A1 1/2004 Peterson, Jr.
2004/0000603 A1 1/2004 Peterson, Jr.
2004/0050976 A1 3/2004 Kitamura
2005/0023380 A1 2/2005 Xu
2005/0023381 A1 2/2005 Xu
2005/0087627 A1 4/2005 Sayar
2005/0087628 A1 4/2005 Sayar
2005/0087630 A1 4/2005 Sayar
2005/0194458 A1 9/2005 Bierstaker et al.
2006/0065763 A1 3/2006 Akabane
2006/0086829 A1 4/2006 Cernoia et al.
2006/0086830 A1* 4/2006 Omura et al. ..... 239/533.12
2006/0096569 A1 5/2006 Goenka et al.
2006/0097075 A1 5/2006 Goenka et al.
2006/0097077 A1 5/2006 Kuronita et al.
2006/0097078 A1 5/2006 Goenka et al.
2006/0097079 A1 5/2006 Goenka et al.
2006/0097081 A1 5/2006 Goenka et al.
2006/0097082 A1 5/2006 Goenka et al.
2006/0097087 A1 5/2006 Goenka et al.
2006/0124774 A1 6/2006 Dantes et al.
2006/0157595 A1 7/2006 Peterson et al.
2006/0191511 A1 8/2006 Mifuji et al.
2006/0226264 A1 10/2006 Bacho, III et al.

* cited by examiner

LOW PRESSURE FUEL INJECTOR NOZZLE

BACKGROUND OF THE INVENTION

1. Technical Field

The present invention is directed to fuel injectors for automotive engines, and more particularly to fuel injector nozzles capable of atomizing fuel at relatively low pressures.

2. Discussion

Fuel injected internal combustion engines are well known in the industry. In direct injected engines, the injection tip of the fuel injector extends into the combustion chamber and includes a perforated plate also known as a metering plate for disbursing and directing fuel injected from the injection valve. In a conventional gasoline engine with port fuel injection system, the injection tip of the injector extends into a cavity or rail of the engine's intake manifold where the injected fuel is mixed with intake air before being discharged into the engine's combustion chamber.

The perforations through the metering plate may be considered as fuel flow passages. It is known in the prior art to form metering plates with a passage by trailing or punching with a tool from either the flow entrance or flow exit side, either parallel to or at an angle to the plate axis resulting in a cylinder passage.

Stringent emission standards for internal combustion engines suggest the use of advanced fuel metering techniques that provide extremely small fuel droplets. The fine atomization of the fuel not only reduces the exhaust emissions but also improves the cold weather start capabilities, the fuel consumption, and the performance. Typically, optimization of the droplet size depends upon the pressure of the fuel and requires high pressure delivery of roughly 7 to 10 MPa. However, a higher fuel delivery pressure causes greater dissipation of the fuel within the cylinder and propagates the fuel further outward away from the injector nozzle. This propagation makes it more likely that the fuel condenses on the walls of the cylinder and on the top surface of the piston which decreases the efficiency of the combustion and increases emissions.

To address these problems, a fuel injection system has been proposed which utilizes low pressure fuel, defined herein generally as less than 4 MPa, while at the same time providing sufficient atomization of the fuel. One exemplary system is found in U.S. Pat. No. 6,712,037 the disclosure of which is hereby incorporated by reference in its entirety. Generally, such low pressure fuel injectors employ sharp edges at the nozzle orifice for atomization and acceleration of the fuel. However, the relatively low pressure of the fuel and sharp edges result in the spray being difficult to direct and reduces the range of the spray. More particularly, the spray angle or cone angle produces by the nozzle is somewhat more narrow. At the same time, additional improvement to the atomization of low pressure fuel would only serve to increase the efficiency and operation of the engine and the fuel injector.

SUMMARY OF THE INVENTION

In view of the above, the present invention is directed to fuel injectors for automotive engines, and more particularly to fuel injector nozzles capable of atomizing fuel at relatively low pressures. The fuel injectors include a nozzle having a valve seat defining a valve outlet and a longitudinal axis; and a metering plate coupled to the valve seat. The metering plate is in fluid communication with the valve outlet and has a center exit cavity arranged approximately along the longitudinal axis, an inner ring of exit cavities, and an outer ring of exit cavities. The inner ring includes at least two exit cavities and the outer ring includes at least three exit cavities.

The metering plate may have the inner and outer rings concentric about the center exit cavity. The exit cavities on the inner ring are approximately spaced circumferentially about a first radius from the center exit cavity and the exit cavities on the outer ring are approximately spaced circumferentially about a second radius from the center exit cavity, the second radius being greater than the first radius, and wherein the exit cavities are spaced an approximately equal circumferential distance apart on the first radius and the exit cavities are not spaced approximately an equal circumferential distance apart on the second radius.

The exit cavities on the inner ring may be approximately spaced circumferentially about a first radius from the center exit cavity and the exit cavities on the outer ring may be approximately spaced circumferentially about a second radius from the center exit cavity, with the second radius being greater than the first radius, and wherein an exit cavity on the outer ring is circumferentially spaced a first circumferential distance from a first adjacent exit cavity on the outer ring and a second circumferential distance from a second adjacent exit cavity on the outer ring, and wherein the first and second circumferential distances are not equal. The second circumferential distance may be greater than the first circumferential distance and wherein the exit cavities on the inner ring are approximately radially centered along the second circumferential distance on the outer ring. Furthermore, the exit cavities on the outer ring may be radially displaced from the exit cavities on the inner ring.

The metering plate includes a nozzle cavity with the exit cavities being located in the nozzle cavity and wherein the outer exit cavities are located on a outer circumference defined by a second radius and wherein the outer circumference is located at least partially within the nozzle cavity and partially outside the nozzle cavity. The bottom wall and side walls of the metering plate at least in part define the nozzle cavity, with the bottom wall sloping toward the center exit cavity wherein the metering plate includes an upper surface defining an upper plane, and wherein the bottom wall is closer to the upper plane proximate to the side walls than the bottom wall is to the upper plane proximate to the center exit cavity. More specifically, the metering plate includes the upper planar surface and has side walls and a bottom surface defining the nozzle cavity, wherein the bottom surface extends upwardly away and toward the upper planar surface from the center exit cavity. The metering plate further includes a protrusion extending from the bottom wall beyond the upper plane, the center exit cavity being located within the protrusion. The center exit cavity is approximately centered within the island or protrusion. Within the nozzle cavity, all of the inner ring and outer rings of exit cavities are located on the bottom wall. The nozzle of claim 14 wherein the island includes an upper island surface and wherein the center exit cavity has a first frusto-conical shape opening toward the upper island surface.

The center exit cavity has a second frusto-conical shape opening away from the upper island surface. The center exit cavity also includes a collimating neck between the first and second frusto-conical shapes. The island or protrusion within which the center exit cavity is located, has side walls with a first slope and upper inner center cavity exit walls having a second slope and wherein the first and second slopes are opposed. The island, protrusion or a center member within the nozzle cavity, which defines the center exit cavity, includes inner side walls that have a greater height than the outer side walls.

The metering plate includes at least three inwardly extending lobes. The inwardly extending lobes is closest to the center exit cavity proximate to one of three exit cavities on the inner ring. The metering plate has at least three outwardly extending lobes and wherein at least one of the outer ring of exit cavities is located within the outwardly extending lobes. The outwardly extending lobes are defined partially by side walls partially formed about a circumference having a radius with the center being approximately located within the center exit cavity. The outwardly extending lobes are defined partially by side wall partially formed about at least three arcuate shapes each having a radius with the center point approximately located on a radial line extending from the center exit cavity and approximately passing through one of the exit cavities on the inner ring. The metering plate includes transition points wherein the arcuate shaped side walls transition to the circumferential side walls, and wherein the transition point occurs within the outwardly extending lobes. The side walls defining the nozzle cavity include at least three inwardly extending lobes, extending toward the exit cavities on the inner ring to minimize the volume of a nozzle cavity defined by the side walls.

Each of the inner exit cavities is located along a radial line extending from the center exit cavity and wherein the inwardly extending lobes each have an arcuate shape and wherein the center point of the radius for the arcuate shape is approximately located along one of the radial lines. The inner ring of exit cavities is within an inner region and the inner exit cavities each have a radius from the center exit cavity and wherein at least two of the inner exit cavities have different radii. The inner ring of exit cavities includes at least one inner exit cavity a first radius from the center exit cavity and wherein the inner ring includes a second inner exit cavity having a second radius from the center exit cavity and wherein the first and second radii are not equal. The outer ring of exit cavities is within an outer region, and the outer exit cavities each have a radius from the center exit cavity and wherein at least two of the outer exit cavities have different radii. The outer ring of exit cavities includes at least one outer exit cavity a first radius from the center exit cavity and the outer ring includes a second outer exit cavity having a second radius from the center exit cavity and wherein the first and second radii are not equal. The inner ring of exit cavities are within an inner region and the outer ring of exit cavities are within an outer region and the inner ring of exit cavities extends from the center exit hole to the outer ring of exit cavities and wherein the outer ring of exit cavities extends outward from the inner ring of exit cavities.

The metering plate forms an approximately planar surface with the inner exit cavities having an angular orientation relative to the planar surface, and wherein the outer exit cavities also have an angular orientation relative to the planar surface and wherein the angular orientation of the outer exit cavities is greater than the angular orientation of the inner exit cavities. The inner exit cavities have an angular orientation with at least two of the inner exit cavity angular orientations being not equal.

A nozzle for a low pressure fuel injector delivering fuel to a cylinder of an engine may further include a valve seat defining a valve outlet and a longitudinal axis, and a metering plate coupled to the valve seat and in fluid communication with the valve outlet, the metering plate including a center island approximately along the longitudinal axis, and an inner ring of exit cavities and an outer ring of exit cavities, and wherein the inner ring includes at least two exit cavities and said outer ring includes at least three exit cavities.

A nozzle for a low pressure fuel injector delivering fuel to a cylinder of an engine, may further include a valve seat defining a valve outlet and a longitudinal axis, a metering plate coupled to the valve seat and in fluid communication with the valve outlet, the metering plate including a longitudinal axis, and an inner ring of exit cavities and an outer ring of exit cavities, and wherein the inner ring includes at least three exit cavities and the outer ring includes at least six exit cavities.

Further scope of applicability of the present invention will become apparent from the following detailed description, claims, and drawings. However, it should be understood that the detailed description and specific examples, while indicating preferred embodiments of the invention, are given by way of illustration only, since various changes and modifications within the spirit and scope of the invention will become apparent to those skilled in the art.

BRIEF DESCRIPTION OF THE DRAWINGS

The present invention will become more fully understood from the detailed description given here below, the appended claims, and the accompanying drawings in which:

DETAILED DESCRIPTION OF THE PREFERRED EMBODIMENT

Figure 1:
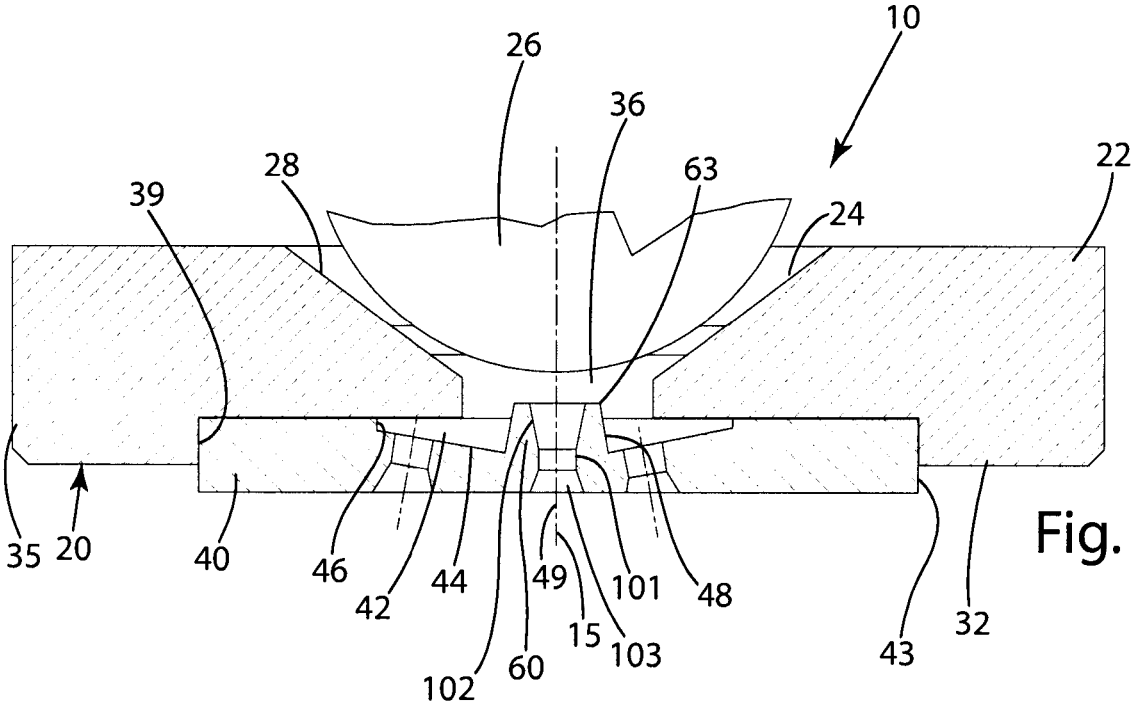
FIG. 1 is a cross-sectional view of a low pressure fuel injector constructed in accordance with the teachings of the present invention.

A low pressure fuel injector nozzle 20 is generally illustrated in a partial cross-sectional view in FIG. 1. The nozzle 20 is formed at a lower end of a low pressure fuel injector 10 which is used to deliver fuel to a cylinder of an engine, such as an internal combustion engine of an automobile. An injector body 22 defines a passageway 24. Located within the passageway 24 and capable of engaging a valve seat 28 is a needle 26, which cooperates with the valve seat 28 to form a needle valve to start and stop fluid flow through the nozzle 20. The injector body 22 is generally aligned along a longitudinal axis 15 and the passageway 24 generally extends along or parallel to the longitudinal axis 15. A lower end of the injector body 22 defines a nozzle body 32. It will be recognized by those skilled in the art that the injector body 22 and nozzle body 32 may be separately formed and the nozzle body 32 may be attached to the distal end of the injector body 22 by welding or other known techniques.

In either case, the nozzle body 32 defines the valve seat 28 leading to a valve outlet 36 of the needle valve. The needle 26 is generally moved along the longitudinal axis 15, in and out of engagement with the valve seat 28, and is usually controlled by an electromagnetic actuator (not shown). In this manner, fluid or fuel flowing through the internal passageway 24 and around the needle 26 is permitted or prevented from flowing to the valve outlet 36 by engagement or disengagement of the needle 26 with the valve seat 28.

Figure 2:
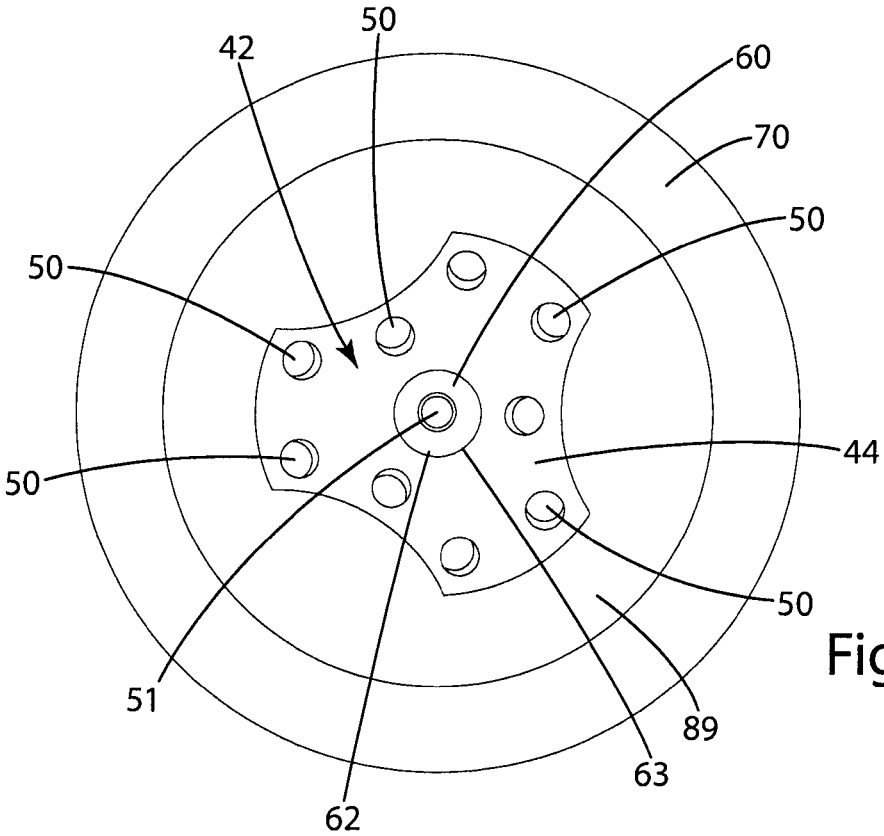
FIG. 2 is a top plan view of a metering plate, which formed a portion of the low pressure fuel injector in claim 1.
Figure 3:
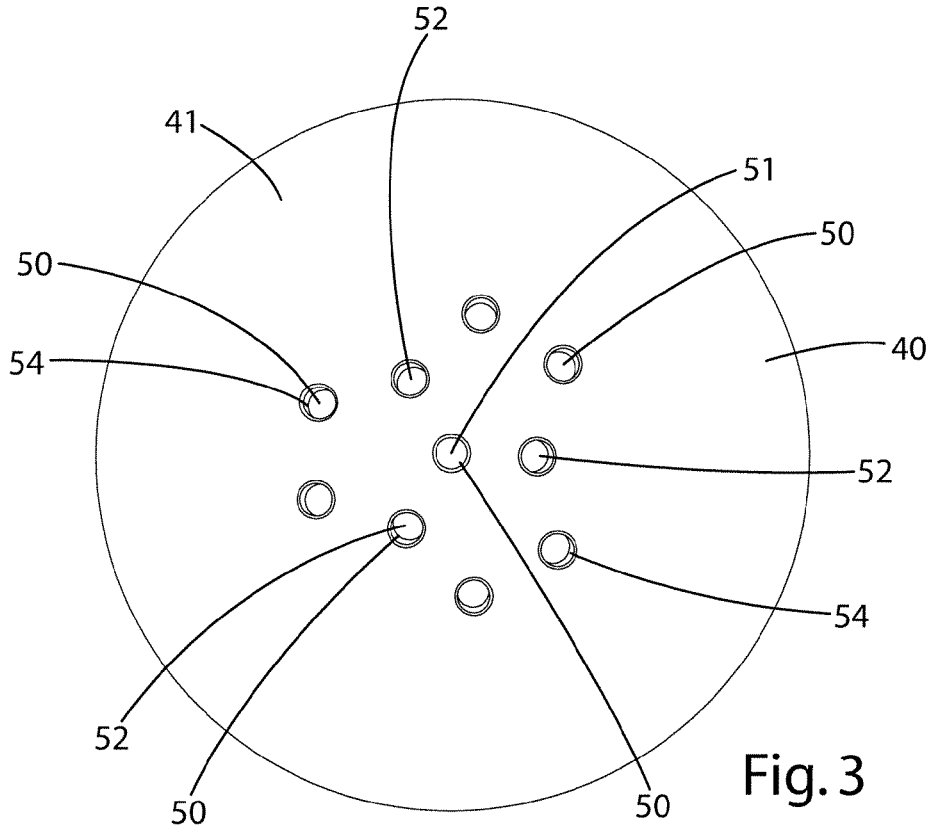
FIG. 3 is a bottom plan view of the metering plate.

The nozzle 20 further includes a metering plate 40, which is attached to the nozzle body 32. It will be recognized to those skilled in the art that the metering plate 40 may be integrally formed with the nozzle body 32, or separately formed and attached to the to the nozzle body 32 by welding or other known techniques. In either case, the metering plate defines a nozzle cavity 42 receiving fuel from the valve outlet 36. The nozzle cavity 42 may be generally defined by both the metering plate 40 and the lower portion 35 of the nozzle body 32, which also defines at least a portion of the valve outlet 36. As illustrated in FIGS. 1 and 2, the metering plate 40 defines the nozzle cavity 42. The nozzle cavity 42 defined by the metering plate 40 is defined by a bottom wall 44 and a side wall 46, as well as a center wall 48. The bottom wall 44 of the nozzle cavity 42 may be sloped or have a radius that forms a concave surface having side walls 46 being shorter than a center wall 48 that defines a protrusion or center island 60. As illustrated in the Figures, a substantial portion of the bottom wall slopes toward the center exit cavity. More specifically, the metering plate 40 has an upper surface 70 which may define an upper plane and the bottom wall 44 is closer to the upper plane proximate the side walls than the upper plane is proximate the center walls. More specifically, the bottom wall 44 approaches to the upper plane as the distance from the center of the metering plate increases. The upward slope of the bottom wall 44 as the distance increases away from the center island 60 minimizes the fuel volume of the nozzle cavity 42. Minimizing the volume of the nozzle cavity improves the injector's durability and its resistance to combustion deposit formation. The upward slope away from the center island 60 of the bottom wall 44 also accelerates the fuel flow within the nozzle cavity before the fuel enters the exit cavities for atomization.

The center island 60 has an upper island surface 62. In the illustrated embodiment, the upper island surface 62 of the center island 60 is substantially planar, although other shapes and configurations may be easily used depending on the desired fuel flow. In the illustrated embodiment, the upper island surface 62 of the center island 60 is above the upper surface 70 of the metering plate 40, which engages or is placed facing the nozzle body 32.

The metering plate 40 may include an outer rim 43, which may be at least partially recessed into the recessed area 39. While the metering plate 40 is illustrated in the figures as being round, other shapes and configurations may be used, however a round metering plate 40 is easier to assemble as they are generally unidirectional. However if the spray pattern produced by the metering plate is direction or desirable to be keyed in a certain direction, the metering plate may be formed in other shapes and configurations to allow easy assembly of the metering plate 40 to the nozzle body 32 with the desired directional spray pattern when the nozzle body 32 is attached as part of the fuel system to an engine.

The center island 60 may include a center exit cavity 51 that provides a highly directed stream of fuel. The center exit cavity 51 is illustrated in the Figures as being centered within the center island 60. Typically, the center exit cavity 51 is also approximately aligned with the longitudinal axis 15 and more specifically is approximately centered below the needle 26, the fuel is directed toward this center exit cavity 51. More specifically, the center exit cavity 51 includes a center exit cavity axis 49 that is typically aligned with or parallel to the longitudinal axis 15. However different locations of the center exit cavity 51 may be used, as in some cases it may be advantageous to move to center exit cavity 51 from being exactly centered, such as to direct fluid flow to a certain area. The center exit cavity 51 in the illustrated embodiment is formed in an opposing frusto-conical shape with a collimating neck 101 therebetween. The collimating neck is generally a cylindrical shape, as illustrated in FIG. 1. More specifically, as illustrated in FIG. 1, the center exit cavity 51 defines a first frusto-conical area 102 that opens toward the upper island surface 62 and a second frusto-conical shape 103 that opens away from the upper island surface 62. While the two frusto-conical shapes 102, 103 may meet, in the illustrated embodiment, the collimating neck 101 separates the two frusto-conical shapes 102, 103. The collimating neck portion 101 is located approximately in the middle of the metering plate and the distance in the illustrated embodiment from the lower surface 41 of the metering plate 40 and the upper surface of the island 62 is generally greater than the distance from the lower surface 41 of the metering plate 40 to the upper surface 89 of the metering plate 40. Since the center exit cavity 51 has a greater distance between the entrance and the exit, the upper frusto-conical shape is generally greater than the other frusto-conical shapes in the metering plate 40. The collimating neck portion 101 of the center exit cavity 51 is generally located approximately half way between the outer upper surface 89 and the lower surface 41, causing the upper frusto-conical shape of the center exit cavity 51 to be greater than the other frusto-conical shapes. However, other shapes and configurations may easily be substituted depending on the desired spray pattern. If the center exit cavity 51 is not centered, the center exit cavity axis 49 is typically not aligned with the longitudinal axis 15 and is angled relative to the longitudinal axis 15. The center exit cavity 51 creates a higher momentum jet emitting from the center of the metering plate. The orientation of the center exit cavity 51 can be tailored to direct the center jet to different location in the engine cylinder to enhance the overall fuel mixture requirement. The corners 63 on the upper part of the center island 62 also create flow separation region where fluid eddies could be generated below. The fluid eddies increase the fluid turbulence being transported along the fluid flow into the nozzle cavities 50 and enhances the atomization of the fuel delivered to the engine cylinder.

Figure 5:
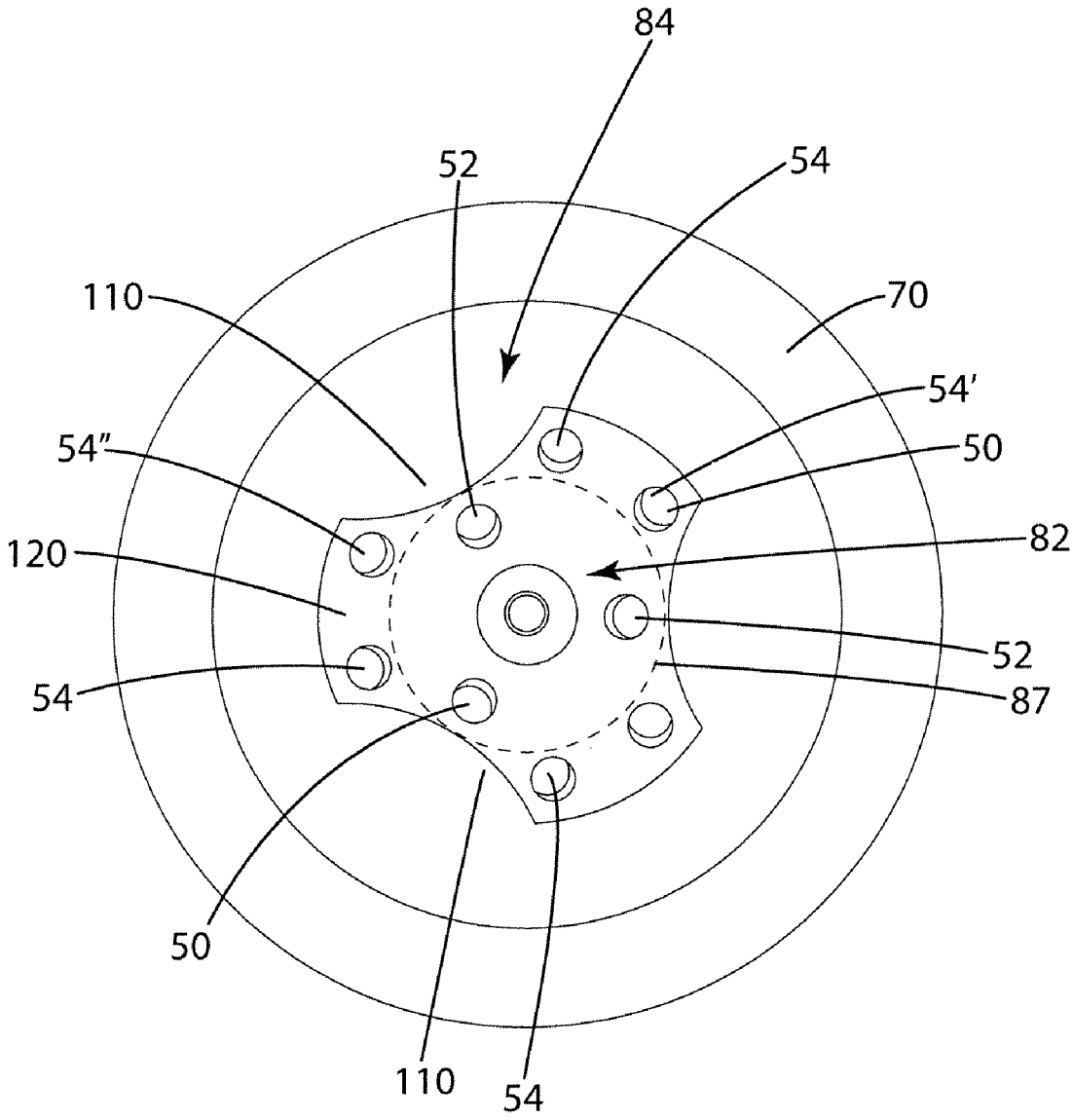
FIG. 5 is a top plan view of the metering plate in FIG. 2 showing an exemplary division between the inner ring of exit cavities and the outer ring of exit cavities.

The nozzle cavity 42 is in communication with at least four exit cavities 50. As illustrated in FIG. 5, at least one exit cavity 50 (an inner exit cavity 52) is located within an inner region 82 and at least one exit cavity 50 (an outer exit cavity 54) within an outer region 84. The inner region 82 is generally defined about an inner ring 83 and the outer region 84 is defined about an outer ring 85. The inner and outer rings 83, 85 are generally concentric about the center exit cavity 51, however depending on the desired spray and configuration, these rings 83 and 85 may be arranged to not be concentric. Generally the inner and outer rings 83, 85 are defined by a circle, ellipse or other shape centered about the center exit cavity 51 with the outer perimeter passing through the average location or distance of the centers of the relevant exit cavities 50, such as the outer ring 85 passing through the average distance of the centers of the outer exit cavities 54 from the center of the center exit cavity 51. The inner ring 83 will generally pass through the average distance of the centers of the inner exit cavities 52 from the center of the center exit cavity 51. Therefore, in most instances and as defined in the Figures, the inner ring 83 will pass through at least a portion of each inner exit cavity 52 and the outer ring 85 will pass through at least a portion of each outer exit cavity 54. Of course, in some instances, some of the exit cavities may be placed so that the inner ring 83 or outer ring 85 does not pass through a portion of the exit cavity 50. The inner and outer regions are generally defined about the inner and outer rings 83 and 85, with the boundary 87 between the inner and outer regions 82 and 84 being approximately defined half way between the inner and outer rings 83 and 85. However, in the illustrated figures, and in particular FIG. 5, the inner region 83 can be defined as being within a circle having a radius that is less than or equal to the distance from the center of the center exit cavity 51 or the center of the metering plate to the innermost side wall 46.

The metering plate 40 as illustrated in the Figures defines at least two inner exit cavities 52 and at least three outer exit cavities 54. The metering plate 40 may define at least three inner exit cavities 52. The metering plate 40 may also generally define up to approximately nine outer exit cavities 54, but preferably and as illustrated in the Figures, up to six outer exit cavities 54. In some cases, exit cavities 50 may be located between the inner and outer rings. The nozzle exit cavities 50 are positioned to intersect with the nozzle cavity 42 along the bottom wall 44. Due to the sloped bottom wall 44, the fluid passing through the injector is rapidly accelerated through the nozzle cavity 42 to the sharp edged exit cavities 50 which enhances turbulence and thus atomization of the fuel delivered to the engine cylinder.

Figure 4:
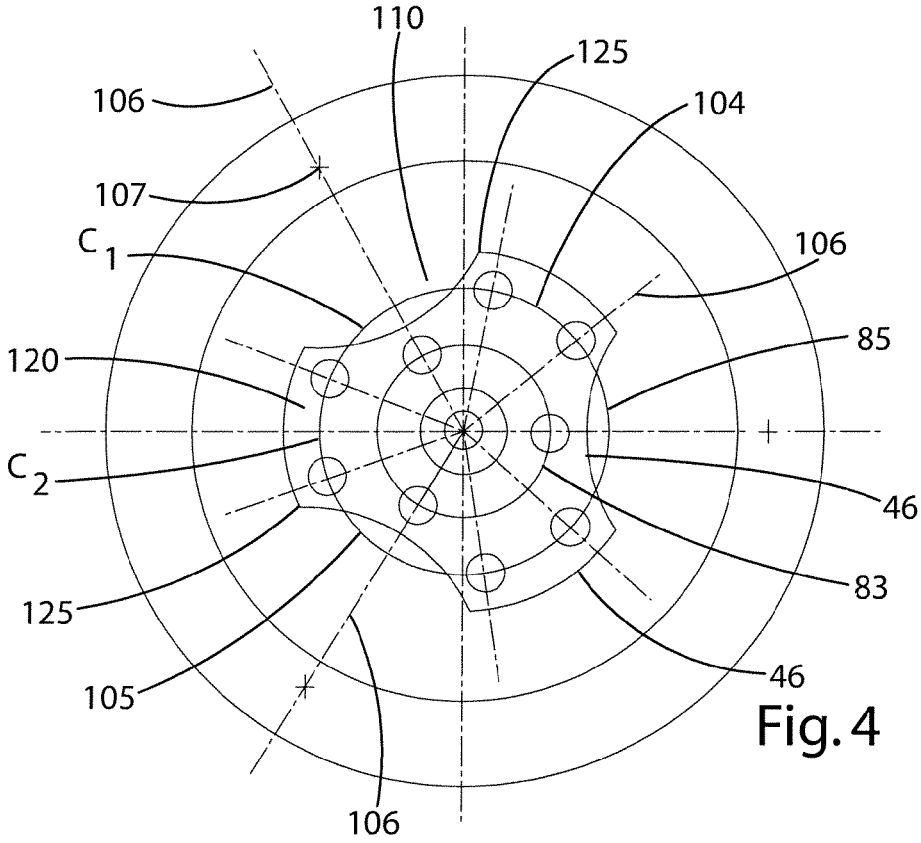
FIG. 4 is a top plan view of the metering plate in FIG. 2, showing relative locations of the exit cavities.

To provide an equally distributed spray of fluid, the exit cavities 50 and in particular the inner exit cavities 52 and outer exit cavities 54 are approximately spaced circumferentially out the respective inner and outer rings 83 and 85. More specifically, the inner exit cavities 52 are generally spaced in an approximately equal circumferential relationship about the inner ring 83. However this circumferential relationship may vary depending on desired placement of the holes. The outer exit cavities 54 are generally spaced in a circumferential relationship about the outer ring 85, however as illustrated in the Figures, the spacing between the outer exit cavities 54 may vary and generally the outer exit cavities 54 are not spaced in an equal circumferential distance apart. The outer exit cavities 54 may be spaced so that a first outer exit cavity 54 on the outer ring 85 is circumferentially spaced a first circumferential distance 104 from a first adjacent outer exit cavity 54' on the outer ring 85 and a second circumferential distance 105 from a second adjacent exit cavity 54". The distances first circumferential distance C, and the second circumferential distance $C_2$ are not equal, but varied to fit within the illustrated configuration of the nozzle cavity 42. As illustrated in FIG. 4, the outer exit cavities are spaced so that the inner exit cavity 52 is approximately located in a radially centered position between the greater circumferential distance between adjacent outer exit cavities. The outer exit cavities 54 are radially displaced from the inner exit cavities 52.

The outer extent of the nozzle cavity 42 is defined by the sidewalls 46. As illustrated in FIG. 4, the outer ring 85 passing through the centers of outer exit cavities 54 is at least partially located within the space defined by the nozzle cavity 42, and at least partially pass through the solid portions of the metering plate that are outside the nozzle cavity 42. More specifically, the outer ring 85 as illustrated in FIG. 4 passes through the side walls adjacent to the outer exit cavities 54. More specifically, the majority of the second circumferential distance 105 that forms the greater circumferential distance between adjacent outer exit cavities 54 on the outer ring 85 is for a majority of the distance outside of the nozzle cavity 42. In comparison, the shorter or first circumferential distance 104 between the illustrated adjacent outer exit cavities as illustrated in FIG. 4 is located completely within the nozzle cavity 42. Therefore, the outer ring is located at least partially within the nozzle cavity and partially outside the nozzle cavity.

The metering plate 40 includes at least three inwardly extending lobes 110 defining portions of the side walls 46. As illustrated in FIG. 4, each inwardly extending lobe 110 is closest to the center exit cavity 51 proximate to one of three inner exit cavities 52. However in some embodiments, the lobes 110 may be further away from the inner exit cavities 52 In the embodiment illustrated in FIG. 4, each of the inner exit cavities 52 is located along a radial line 106 extending from the center exit cavity 51, and the inwardly extending lobes 110 each have an arcuate shape with the center point 107 of the radius for the arcuate shape being approximately located along one of the radial lines 106.

The metering plate 40 also defines at least three outwardly extending lobes 120 that form part of the nozzle cavity. As illustrated in FIG. 4, the outer exit cavities 54 are generally located within these outwardly extending lobes 120. The outwardly extending lobes 120 are defined at least partially by the side walls 46 and are partially formed about a circumference having a radius with the center being approximately located within the center exit cavity 51. More specifically, the outwardly extending lobes 120 are defined partially by the side wall 46 and are partially formed about at least three arcuate shapes each having a radius with the center point approximately located on a radial line extending from the center exit cavity. In the illustrated embodiment, this radial line also passes approximately through one of the inner exit cavities 52. As further illustrated in FIG. 4, the side walls 46 defining the inwardly extending lobes 110 and the outwardly extending lobes 120 include a transition point 125 where the side walls 46 transition from having an arcuate shape formed along a radius centered approximately near the center exit cavity 51 to a arcuate shape having a radius centered about a point 107 along a radial line 106 extending from the center exit cavity 51 where the point 107 is displaced from the center, and the radial line 106 extends approximately centered between adjacent outer exit cavities 54. More specifically, the radial line extends between the adjacent outer exit cavities 54 having a larger or second circumferential distance 105 between the outer exit cavities 54. As further illustrated in FIG. 4, the transition point 125 occurs within the outwardly extending lobes 120. The inwardly extending lobes 110 are designed to minimize the volume of the nozzle cavity. The outwardly extending lobes 120 are also design to minimize the volume of the nozzle cavities. More specifically, the lobes 110, 120 are configured to pass in close proximity to the inner and outer exit cavities 52, 54 and in doing so both minimize the volume of the nozzle cavity 42 as well as direct the fuel flow in an efficient manner to each of the exit cavities 50 and to allow a measured amount of fuel to flow out of each exit cavity 50. In general, for the nozzle exit cavities 50, it is expected that an equal amount of fuel will flow out of the inner and outer exit cavities.

The angular orientation of the nozzle exit cavities 50 may also vary to direct flow. In some embodiments, where the metering plate 40 forms an approximately planar surface and the inner exit cavities 52 have an angular orientation relative to the planar surface, and the outer exit cavities 54 also have an angular orientation relative to the planar surface, the angular orientation of the outer exit cavities 54 may be greater than the angular orientation of the inner exit cavities 52. The angular orientation of the exit cavities 50 may vary depending on the desired spray pattern. In some embodiments, the angular orientation of the inner exit cavities may not be equal and in some instances the angular orientation of the outer exit cavities may not be equal.

The foregoing discussion discloses and describes an exemplary embodiment of the present invention. One skilled in the art will readily recognize from such discussion, and from the accompanying drawings and claims that various changes, modifications and variations can be made therein without departing from the true spirit and fair scope of the invention as defined by the following claims.

What is claimed is:

1. A nozzle for a low pressure fuel injector, the fuel injector delivering fuel to a cylinder of an engine, the nozzle comprising:

a valve seat defining a valve outlet and a longitudinal axis; and a metering plate coupled to said valve seat and in fluid communication with said valve outlet, said metering plate including a center exit cavity arranged approximately along said longitudinal axis, and at least two inner exit cavities and at least three outer exit cavities and wherein said metering plate further includes a bottom wall and side walls defining a nozzle cavity, and wherein a substantial portion of said bottom wall slopes toward said center exit cavity wherein said metering plate includes an upper surface defining an upper plane, and wherein said bottom wall is closer to said upper plane proximate to the side walls than said bottom wall is to said upper plane proximate to said center exit cavity.

2. A nozzle for a low pressure fuel injector, the fuel injector delivering fuel to a cylinder of an engine, the nozzle comprising:

a valve seat defining a valve outlet and a longitudinal axis; and a metering plate coupled to said valve seat and in fluid communication with said valve outlet, said metering plate including a center exit cavity arranged approximately along said longitudinal axis, and at least two inner exit cavities and at least three outer exit cavities and wherein said metering plate further includes an upper surface defining an upper plane, and a bottom wall and a side wall at least partially defining a nozzle cavity, and wherein said metering plate includes a protrusion extending from said bottom wall beyond said upper plane, said center exit cavity being located within said protrusion.

3. A nozzle for a low pressure fuel injector, the fuel injector delivering fuel to a cylinder of an engine, the nozzle comprising:

a valve seat defining a valve outlet and a longitudinal axis; and a metering plate coupled to said valve seat and in fluid communication with said valve outlet, said metering plate including a center exit cavity arranged approximately along said longitudinal axis, and at least two inner exit cavities and at least three outer exit cavities and wherein said metering plate further includes an island extending from a bottom wall of a nozzle cavity, said center exit cavity being approximately centered within said island.

4. The nozzle of claim 1 wherein all of said inner and outer exit cavities are located on said bottom wall.

5. The nozzle of claim 1 wherein said metering plate further includes an island protruding from the center of said nozzle cavity and wherein said center exit cavity is located within said island.

6. A nozzle for a low pressure fuel injector, the fuel injector delivering fuel to a cylinder of an engine, the nozzle comprising:

a valve seat defining a valve outlet and a longitudinal axis; and a metering plate coupled to said valve seat and in fluid communication with said valve outlet, said metering plate including a center exit cavity arranged approximately along said longitudinal axis, and at least two inner exit cavities and at least three outer exit cavities and wherein said metering plate further includes an island in the center of a nozzle cavity and wherein said center exit cavity is located within said island and wherein said island includes an upper island surface and wherein said center exit cavity has a first frusto-conical shape opening toward said upper island surface.

7. The nozzle of claim 6 wherein said center exit cavity has a second frusto-conical shape opening away from said upper island surface.

8. The nozzle of claim 7 wherein said center exit cavity includes a collimating neck between said first and second frusto-conical shapes.

9. The nozzle of claim 5 wherein said island includes a side wall with a first slope and an upper inner center cavity exit wall having a second slope and wherein the first and second slopes are opposed.

10. A nozzle for a low pressure fuel injector, the fuel injector delivering fuel to a cylinder of an engine, the nozzle comprising:

a valve seat defining a valve outlet and a longitudinal axis; and a metering plate coupled to said valve seat and in fluid communication with said valve outlet, said metering plate including a center exit cavity arranged approximately along said longitudinal axis, and at least two inner exit cavities and at least three outer exit cavities and wherein said metering plate further includes a bottom wall an inner side wall, and outer side walls defining a nozzle cavity and wherein said inner side wall defines a center member that defines the center exit cavity, and wherein said inner side wall has a greater height than said outer side walls.

11. The nozzle of claim 1 wherein said metering plate includes at least three inwardly extending lobes, defined by said walls and wherein said side walls extend between said upper surface and said bottom wall.

12. The nozzle of claim 11 wherein each of said inwardly extending lobes is closest to the center exit cavity proximate to one of three inner exit cavities.

13. The nozzle of claim 11 wherein each of said inner exit cavities is located along a radial line extending from said center exit cavity and wherein said inwardly extending lobes each have an arcuate shape and wherein the center point of the radius for said arcuate shape is approximately located along one of said radial lines.

14. A nozzle for a low pressure fuel injector, the fuel injector delivering fuel to a cylinder of an engine, the nozzle comprising:

a valve seat defining a valve outlet and a longitudinal axis; and a metering plate coupled to said valve seat and in fluid communication with said valve outlet, said metering plate including a center exit cavity arranged approximately along said longitudinal axis, and at least two inner exit cavities and at least three outer exit cavities and wherein said metering plate defines a nozzle cavity having at least three outwardly extending lobes and wherein at least one of said outer exit cavities is located within said outwardly extending lobes.

15. The nozzle of claim 14 wherein said outwardly extending lobes are defined partially by side walls partially formed about a circumference having a radius with the center being approximately located within said center exit cavity.

16. The nozzle of claim 15 wherein said outwardly extending lobes are defined partially by side walls partially formed about at least three arcuate shapes each having a radius with the center point approximately located on a radial line extending from the center exit cavity and approximately passing through one of the inner exit cavities.

17. The nozzle of claim 16 including transition points wherein said arcuate shaped side walls transition to said circumferential side walls, and wherein said transition point occurs within said outwardly extending lobes.

18. The nozzle of claim 1 wherein said side walls extend between said bottom wall and said upper surface and wherein said side walls include at least three inwardly extending lobes, extending toward said inner exit cavities to minimize the volume of said nozzle cavity defined by said side walls.

19. The nozzle of claim 1 and wherein said bottom wall extends upwardly away from said center exit cavity and toward said upper planar surface.

20. A nozzle for a low pressure fuel injector, the fuel injector delivering fuel to a cylinder of an engine, the nozzle comprising a metering plate coupled to a valve seat and in fluid communication with a valve outlet, said metering plate including a nozzle cavity defined at least partially by side walls, and wherein said side walls include at least three inwardly extending lobes, and three outwardly extending lobes and wherein said metering plate further includes at least one exit cavity within the area defined by each of said outwardly extending lobes, and a center exit cavity wherein said metering plate includes at least three inner exit cavities, each in close proximity to one of said inwardly extending lobes and wherein each of said inner exit cavities is located inward of said inwardly extending lobes.

* * * * *

UNITED STATES PATENT AND TRADEMARK OFFICE

CERTIFICATE OF CORRECTION

PATENT NO. : 7,669,789 B2
APPLICATION NO. : 11/846585
DATED : March 2, 2010
INVENTOR(S) : David Ling-Shun Hung, Vivek A. Jairazbhoy and David L. Porter It is certified that error appears in the above-identified patent and that said Letters Patent is hereby corrected as shown below:

Column 5, Line 2, should read as follows: -- formed and attached to the nozzle body 32 by welding --

Column 10, Line 29, should read as follows: -- tom wall, an inner side wall, and outer side walls defining --

Column 11, Line 13, should read as follows: -- 19. The nozzle of claim 1 wherein said bottom wall --

Signed and Sealed this

Twentieth Day of April, 2010

David J. Kappos

David J. Kappos
*Director of the United States Patent and Trademark Office*